United States Patent [19]

Stephens

[11] 4,261,194

[45] Apr. 14, 1981

[54] MULTIPLE INDENT DIE COMPRESSION TOOL

[75] Inventor: Francis E. Stephens, Webster Groves, Mo.

[73] Assignee: International Telephone and Telegraph Corporation, New York, N.Y.

[21] Appl. No.: 60,021

[22] Filed: Jul. 23, 1979

[51] Int. Cl.[3] ..... B21D 37/10

[52] U.S. Cl. ..... 72/402; 72/453.15

[58] Field of Search ..... 72/402, 409, 410, 412, 72/452, 453.15, 453.16, 399, 400, 401

[56] References Cited

U.S. PATENT DOCUMENTS

| | | | |
|---|---|---|---|
| 3,154,981 | 11/1964 | McDurmont | 81/301 |

FOREIGN PATENT DOCUMENTS

| | | | |
|---|---|---|---|
| 677285 | 12/1963 | Canada | 72/402 |
| 1447123 | 7/1962 | France | 72/416 |
| 402102 | 2/1974 | U.S.S.R. | 72/410 |
| 526978 | 10/1976 | U.S.S.R. | 72/402 |
| 573231 | 9/1977 | U.S.S.R. | 72/402 |

*Primary Examiner*—Lowell A. Larson
*Assistant Examiner*—Gene P. Crosby
*Attorney, Agent, or Firm*—James B. Raden; William J. Michals

[57] ABSTRACT

A multiple indent die device for use with compression tools for crimping ductile tubular connectors on cables and the like. The device includes a pair of opposed die holders adapted for mounting between the ram and anvil of a compression tool for movement toward and away from each other. Each die holder includes a constrained indentor die which moves relative to the other indentor die and solely in the direction of movement of the die holders. A first movable indentor die is pivotally mounted to one of the die holders and about an axis which is parallel to the axis of the tubular connector and engages an inclined surface on the other die holder for radially inward movement toward the axis of the tubular connector and generally between the constrained indentor dies as the die holders are moved toward one another. A second movable indentor die is similarly mounted to either one of the die holders for engaging an inclined surface on its opposed die holder.

14 Claims, 6 Drawing Figures

MULTIPLE INDENT DIE COMPRESSION TOOL

BACKGROUND OF THE INVENTION

This invention relates to a compression tool for crimping electrical connectors onto cable ends and, more particularly, to an insertable multiple indent die device for such tools.

Compression tools including insert dies disposed between the anvil and hydraulic ram of the tool for crimping a connector into intimate contact with a conductor embedded therein are known and have been widely used in the art. These tools generally fall into two catagories. The first being the circumferential insert dies which are typically either round or hexagon in shape and wherein a conductor is inserted into a tubular shaped or barrel connector and wherein the dies which are comprised of two equal sections are closed to crimp the connector into intimate contact with the conductor. The second type is the indent type which typically consists of a stationary "V"-shaped die section into which the tubular shaped connector is nested. The indentor die which is also "V"-shaped is mounted on the end surface of the hydraulic ram of the compression tool with the tip of the "V" being rounded so that it compresses the wall of the connector into contact with the conductor without puncturing the wall of the connector. While these insert dies have worked quite well, they nevertheless require a different tubular connector size for each conductor size that is to be crimped. Accordingly, a large number of different connector sizes must be stocked in order to meet the varying needs of different conductor size applications.

Another type of compression tool is exemplified in U.S. Pat. No. 3,154,981 which provides a four-way crimping tool which yields a completely symmetrical four-way crimp on a single connector sleeve, and covering a wide range of conductor diameters. However, this type of compression tool is a unitary device which requires an integral hydraulic tool permanently attached to the crimping dies. These and other disadvantages are overcome by the present invention wherein there is provided an insertable multiple indent die device for use with existing hydraulic tools which normally utilize the circumferential type dies and which can be utilized to crimp a conventional or single tubular connector sleeve size which can accommodate numerous sizes of conductors or cable ends.

SUMMARY OF THE INVENTION

Briefly, a multiple indent die device which is insertable in a crimping tool for crimping hollow ductile metallic connectors having a generally longitudinal axis onto a elongated member inserted in the connector by crimping the connector about a portion of the length thereof and in four peripherally spaced and inward directions is provided. The device compresses a pair of opposed die holders adapted for mounting within the tool for movement toward and away from each other and each die holder includes a constrained indentor die mounted thereon for movement relative to the other one of said dies solely in the direction of movement of the die holders. A first movably mounted indentor die is pivotally mounted to one of the holders about an axis which is parallel to the axis of the connector and cammingly engages an inclined surface of the other one of the dies for movement toward the elongated member in response to the movement of the die holders toward one another. A second movably mounted indentor die is pivotally mounted to one of the holders about an axis which is also parallel to the axis of the connector for cammingly engaging a second inclined surface on the opposed die holder for movement toward the elongated member in response to the movement of the die holders toward one another.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
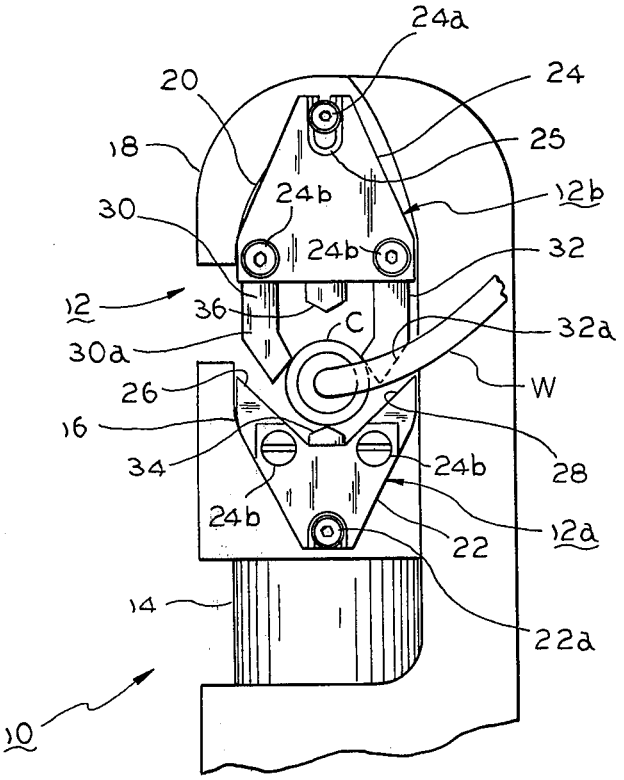
FIG. 1 is a fragmentary plan view of a hydraulic compression tool having the insertable die device, in accordance with the principles of the present invention, mounted therein for crimping a tubular connector about a wire end.
Figure 2:
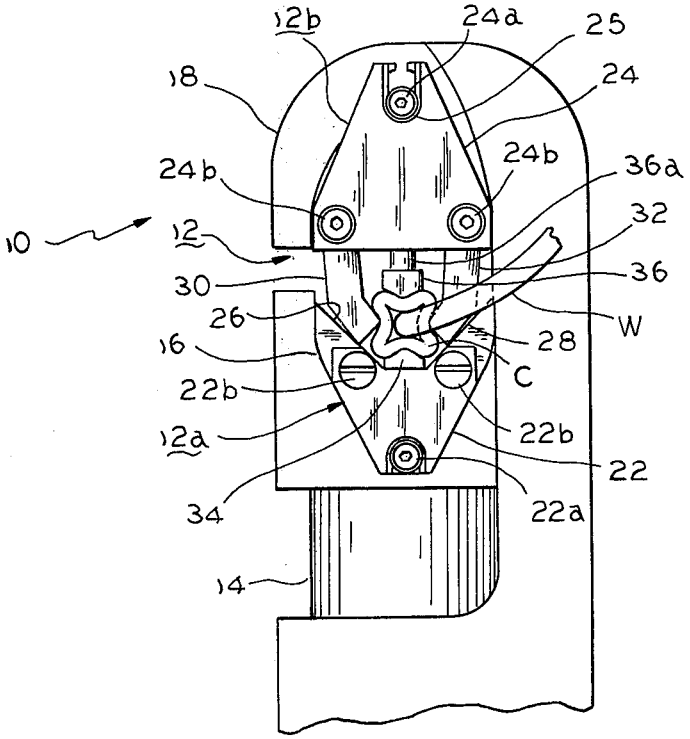
FIG. 2 is a plan view similar to that of FIG. 1 but showing the insertable die device in its closed or crimped connector position.

Referring now to FIGS. 1 and 2 there is shown generally at 10 a compression tool including the insertable multiple indent die device shown generally at 12, in accordance with the present invention. Tool 10 includes a movable hydraulic ram 14 having a generally semi-circular die receiving portion 16 and a stationary anvil member 18 which similarly includes a semi-circular die receiving portion 20. Ram 14 is powered by a external source (not shown) as is well known in the art.

Die device 12 includes die holder **12*a* and 12*b* which are mounted to the ram and anvil portions of tool 10 by way of adapter plates 22 and 24 which are secured to the respective tool portions by way of threaded fasteners 22*a* and 24*b*, respectively. Adapter plates 22 and 24 are secured to die holders 12*a* and 12*b* by way of threaded fasteners 22*b* and 24*b*, respectively. Die holder 12*a* includes a pair of inclined surfaces 26 and 28 which respectively engage a pair of movable pivotally mounted indentor dies 30 and 32 of die holder 12*b*. Die holder 12*a* further includes a constrained indentor die 34 which is disposed intermediate to inclined surfaces 26 and 28. Die holder 12*b* further includes a relatively movable indentor die 36 which is constrained for relative movement solely in a direction of movement of die holders 12*a* and 12*b***.

As will be discussed more fully hereinafter, adapter plate 24 includes a slot portion 25 which cooperates with structure attached to indentor die 36 to provide a lost-motion mounting wherein die holder **12*b*** is translatable over a predetermined distance toward and away from its anvil mounting.

Referring generally to the operation of tool 10 and, more particularly, insertable indentor die device 12 mounted therein, FIGS. 1 and 2 are further illustrated with a typical tubular or barrel connector C which is crimped into intimate contact with a wire or cable end W by the operation of the indentor die device in accordance with the teachings of the present invention. As die holders 12*a* and 12*b* are translated toward one another, by operation or movement of ram 14, the inner surface portion of pivotally mounted indentor dies 30 and 32 initially engage the barrel of the crimp connector C which is also in contact with the upper portion of constrained indentor die 34. As the dies continue to close or move toward one another the inclined surfaces 30*a* and 32*a* of indentor dies 30 and 32 cammingly engage inclined surfaces 26 and 28, respectively. Accordingly, the inner surfaces or contact lines of indentor dies 30 and 32 are moved radially inwardly toward the axis of tubular crimp connector C. At this time the lower or contact surface of constrained indentor die 36 contacts a fourth point of crimped connector C. As the ram continues its forward motion, all four indentor dies move uniformly inwardly thereby crimping connector C into intimately contact with conductor W and in all four quadrants thereof as illustrated in FIG. 2. It can be seen by reference to FIG. 2 that in the final or crimped position, die holder 12*b* is translated upwardly into the nest of the anvil 18 at which time the bottom portion of slot 25 just contacts fastener 24*a*. As will be discussed more fully hereinafter, constrained indentor die 36 includes an integral rigid or rod member 36*a* which slidably engages and extends through an opening of die holder 12*b* and into engagement with the adjacent surface of anvil 18. In this regard, as is described more fully hereinafter, die holder 12*b* is biased downwardly toward die holder 12*a* by means of suitable bias means such as a compression spring herein illustrated as a coil spring 27 disposed about rod member 36 and between the lower surface of anvil 18 and the upper surface of die holder 12*b* as illustrated more clearly in FIG. 3. It should also be appreciated by those skilled in the art that the bias means may also take the form of a Belville spring or any other suitable spring device.

Figure 3:
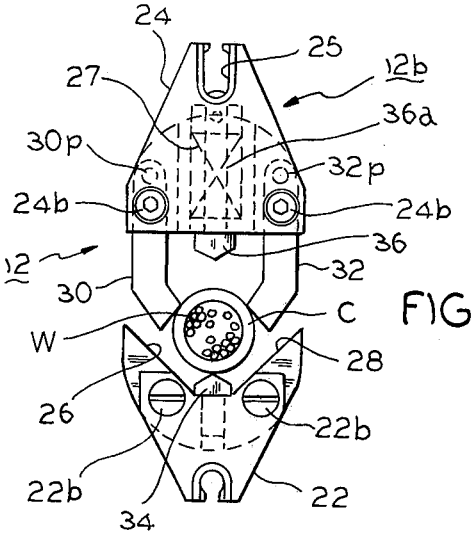
FIGS. 3 and 4 are plan views of the insertable die device illustrating in greater detail the operation thereof in accordance with the present invention.
Figure 4:
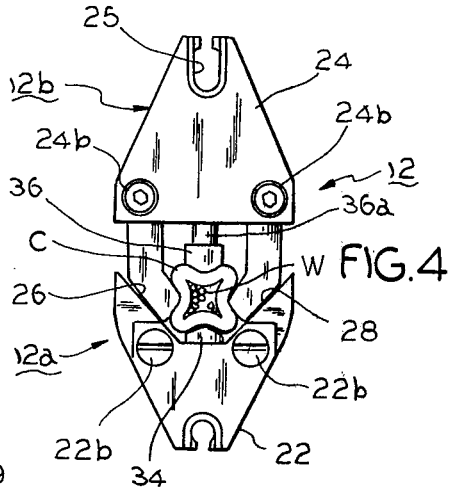

Referring now to FIGS. 3 and 4 there are shown plan views of die device 12 and illustrating somewhat more clearly the lost-motion mounting technique previously alluded to. This lost-motion mounting is utilized to ensure full symmetrical crimping in all four quadrants and particularly with respect to the upper indentor die 36. That is, the other three indentor dies effectively advance into the crimp connector prior to indentor die 36, and the added relative movement provided by the lost-motion mounting ensure a full crimp in that quadrant. As previously described in coil spring 27 is disposed coaxially with and about rod 36*a* and is constrained by means of a bushing 29 which is fastened to the upper end of rod 36*a* by way of a set screw fastener 29*a*. In operation, the upper end of rod 26*a* engages the surface of anvil 18 of the associated tool. The lower end of spring 27 engages the upper surface of a recessed bore which is provided in the upper surface of die holder 12*b*. Accordingly, once installed, die holder 12*b* is yieldably biased away from anvil 18. However, as the incline surfaces of pivotally mounted indentor dies 30 and 32 engage the corresponding or complementary inclined surfaces 26 and 28 of die holder 12*a*, die holder 12*b* is translated upwardly toward anvil 18 and against the bias provided by spring 27. It can also be seen by reference to FIG. 3 that pivotally mounted indentor dies 30 and 32 are respectively mounted to die holder 12*b* by way of pivot pins 30*p* and 32*p*.

Figure 5:
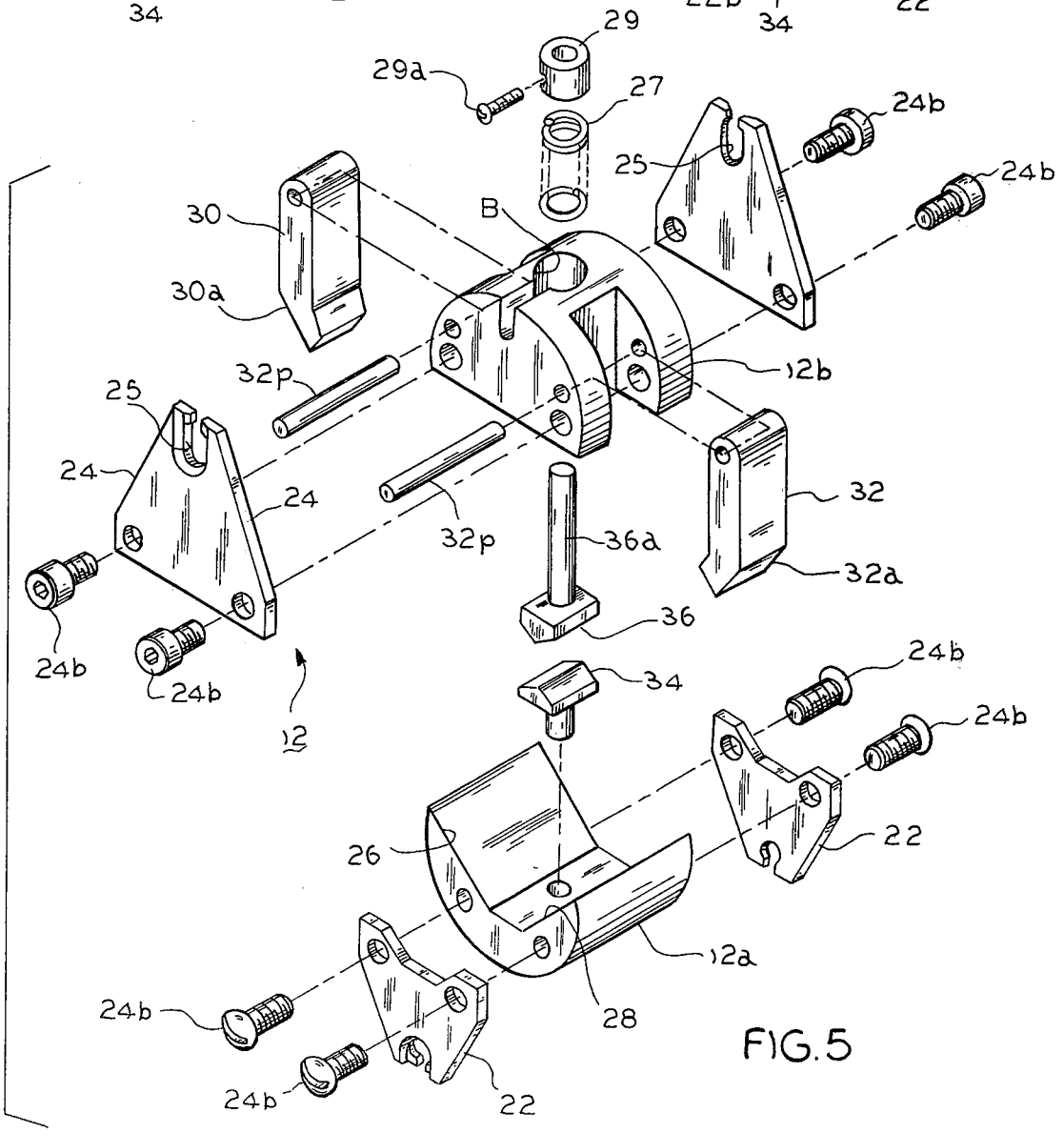
FIG. 5 is an exploded view of the insertable die device of the previous drawing figures; and, FIG. 6 is an exploded view of an alternate embodiment of the insertable multiple indent die device in accordance with the teachings of the present invention.

Referring now to FIG. 5 there is shown an exploded view of the insertable multiple indent die device 12 of the previous drawing figures. It can be seen that die device 12 includes a pair of essentially identical adapter plates on each of die holders 12*a* and 12*b*. It can also be seen that spring 27 is disposed within a suitable bore B provided on the upper surface of die holder 12*b* and which extends a given distance into die holder 12*b*. Bore B also includes a keyhole-type extension which accommodates the protruding length of set screw 29*a* from bushing 29.

Figure 6:
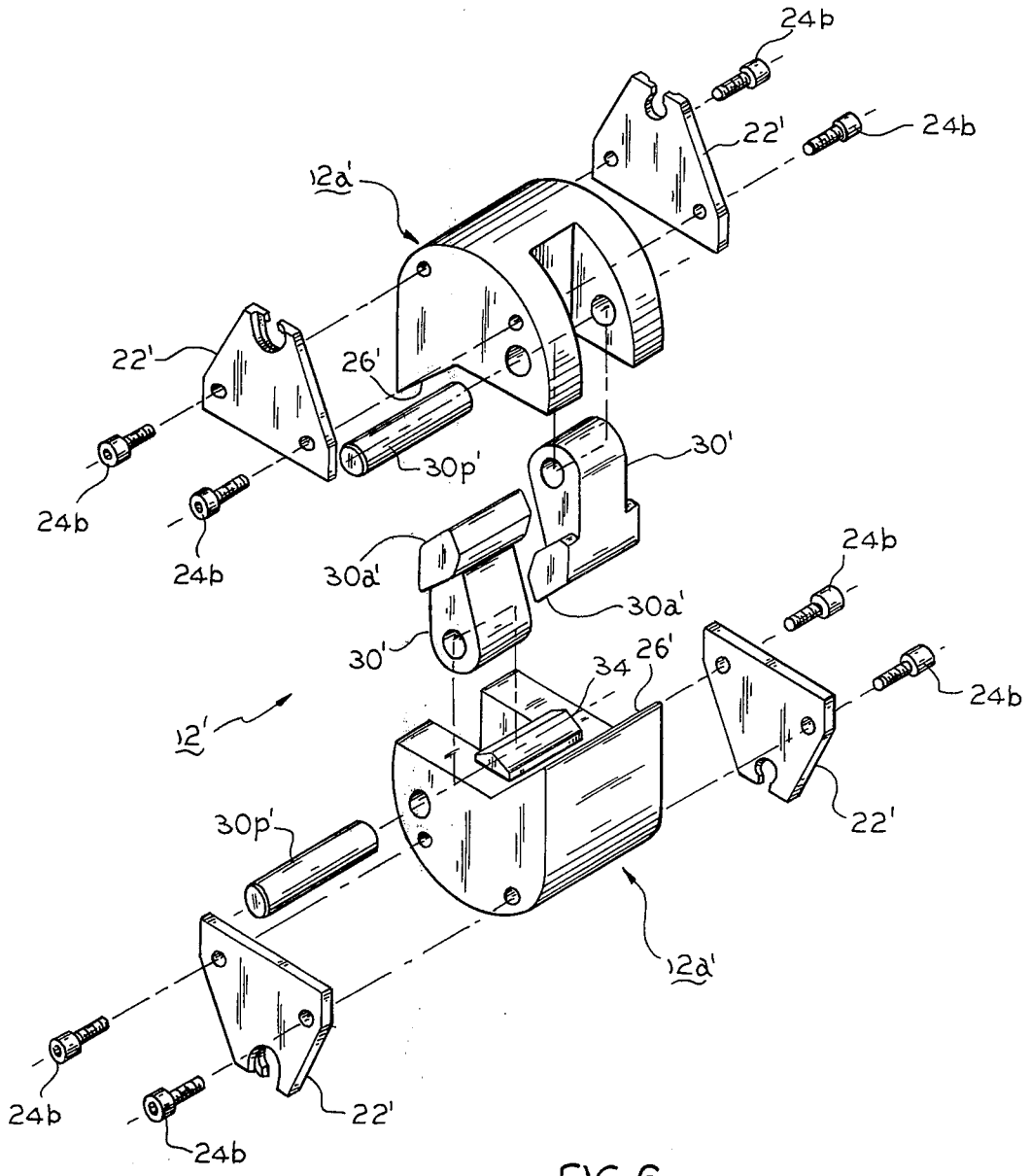

Referring now to FIG. 6 there is shown an exploded view of an alternate embodiment of the insertable indentor die device in accordance with the principles of the present invention. The alternate embodiment is shown generally at 12' and includes a pair of essentially identical die holders 12*a'*. Each die holder includes a pivotally mounted indentor die 30' which is mounted to its respective die holder by means of a pivot pin 30*p'* which is disposed in a pair of bores extending coaxially through a clevis-type cutout portion of die holder 12*a'*. It should be noted that this embodiment functions to fully crimp a given range of wire sizes without the lost-motion mounting technique illustrated with respect to the previous drawing figures. That is, since the indentor dies advance symmetrically into and towards the center of the connector, an added relative movement of one of the dies therefore is not required. However, it has been found that since the pivotally mounted indentor dies of the embodiment of FIG. 6 move in opposite directions relative to one another, a slight rotation is imparted to the crimp connector. The effect of this rotational tendency is to somewhat limit the crimping range relative to smaller wire sizes. Nevertheless, it will be appreciated by those skilled in the art that the embodiment of the present invention illustrated in FIG. 6 has the advantage that the respective die holders are essentially identical and accordingly the economies of scale with respect to the production of the die holders can be advantageously utilized. That is, this embodiment essentially doubles the quantity requirement for a single die holder type, while eliminating the need for a second, distinct die holder. Accordingly, this feature reduces the overall production cost of the insertable indentor die device in accordance with the principles of the present invention.

What has been taught, then, is an insertable indentor die device for providing a symmetrical four-way crimp on a single connector sleeve accommodating a wide range of conductor diameters and facilitating, notably, the use of existing compression tools which need not be singularly dedicated to a particular die structure. The forms of the inventions illustrated and described herein are but preferred embodiments of these teachings. They are shown as illustrations of the inventive concepts, however, rather than by way of limitation, and it is pointed out that various alterations and modifications may be indulged in within the scope of the appended claims.

What is claimed is:

1. A crimping tool for crimping a tubular ductile metallic connector onto an electrical conductor by crimping the connector about a portion of the length thereof and in four circumferentially spaced and in radially inward directions, said tool comprising, in combination:

a pair of opposed die holders mounted within said tool for movement toward and away from each other, with each die holder having a constrained indentor die member mounted thereon for relative movement solely in the direction of movement of said die holders;

a first movably mounted indentor die pivotally mounted to one of said holders about an axis which is parallel to the axis of said tubular connector and cammingly engaging an inclined surface of the other one of said die holders for movement toward said axis of said tubular connector as said die holders are moved toward one another; and, a second movably mounted indentor die pivotally mounted to one of said holders about an axis which is parallel to the axis of said tubular connector for cammingly engaging a second inclined surface on the opposed die holder for movement toward said axis of said tubular connector as said holders are moved toward one another.

2. The crimping tool according to claim 1, wherein said first and second pivotally mounted indentor dies are each mounted to a common one of said die holders and wherein said other one of said die holders includes both of said inclined surfaces.

3. The device according to claim 2, wherein each of said indentor dies includes an elongated and cross-sectionally generally triangular connector engaging surface with the apex thereof being generally directed toward, and forming a connector engaging line generally parallel to, said axis of said connector.

4. The crimping tool according to claim 1, wherein each of said die holders includes one of said first and second movably mounted indentor dies which engages one of said inclined surfaces on the other of said die holders.

5. The device according to claim 4, wherein each of said indentor dies includes an elongated and cross-sectionally generally triangular connector engaging surface with the apex thereof being generally directed toward, and forming a connector engaging line generally parallel to, said axis of said connector.

6. The crimping tool according to claim 1, wherein said die holders are mounted between a moving ram and fixed anvil of said tool and wherein a first one of said dies is mounted adjacent said anvil and includes a lost-motion mounting wherein said first one of said die holders is translatable over a predetermined distance toward and away from said anvil and wherein said constrained indentor die of said first one of said die holders includes means for yieldably urging said first one of said die holders away from said anvil.

7. The crimping tool according to claim 6, wherein said indentor die of said first one of said die holders includes a member slidably engaging and extending through an opening in said first one of said die holders and into engagement with said anvil and wherein a spring is provided between said first one of said die holders and said anvil.

8. A multiple indent die device which is insertable in a crimping tool for crimping a hollow ductile metallic connector having a generally longitudinal axis onto an elongated member inserted in said connector by crimping the connector about a portion of the length thereof and in four peripherally spaced and inward directions, said device comprising, in combination:

a pair of opposed die holders adapted for mounting within said tool for movement toward and away from each other with each die holder having a constrained indentor die member mounted thereon for relative movement solely in the direction of movement of said die holders;

a first movably mounted indentor die pivotally mounted to one of said holders about an axis which is parallel to said axis of said connector and cammingly engaging an inclined surface of the other one of said die holders for movement toward said elongated member in response to the movement of said die holders toward one another; and, a second movably mounted indentor die pivotally mounted to one of said holders about an axis which is parallel to said axis of said connector for cammingly engaging a second inclined surface on the opposed die holder for movement toward said elongated member in response to the movement of said die holders toward one another.

9. The device according to claim 8, wherein said first and second pivotally mounted dies are each mounted to a common one of said die holders and wherein said other one of said die holders includes both of said inclined surfaces.

10. The device according to claim 8, wherein each of said die holders includes one of said first and second movably mounted dies which engages one of said inclined surfaces on the other of said die holders.

11. The device according to claim 9, wherein each of said indentor dies includes an elongated and cross-sectionally generally triangular connector engaging surface with the apex thereof being generally directed toward said axis of said connector.

12. The device according to claim 10, wherein each of said indentor dies includes an elongated and cross-sectionally generally triangular connector engaging surface with the apex thereof being generally directed toward said axis of said connector.

13. A multiple indent die device which is insertable in a crimping tool for crimping a hollow ductile metallic connector having a generally longitudinal axis onto an elongated member inserted in said connector by crimping the connector about a portion of the length thereof and in four peripherally spaced and inward directions, said device comprising, in combination:

a pair of opposed die holders adapted for mounting within said tool for movement toward and away from each other with each die holder having an indentor die member mounted thereon for relative movement in the direction of movement of said die holders;

a first movably mounted indentor die pivotally mounted to one of said holders about an axis which is parallel to said axis of said connector, wherein said first movably mounted indentor die cammingly engages an inclined surface of the other one of said die holders for movement toward said elongated member in response to the movement of said die holders toward one another; and, a second movably mounted indentor die pivotally mounted to one of said holders about an axis which is parallel to said axis of said connector for cammingly engaging an inclined surface on its opposed die holder for movement toward said elongated member in response to the movement of said die holders toward one another.

14. The device according to claim 13, wherein said first and second pivotally mounted dies are each mounted to a common one of said die holders and wherein said other one of said die holders includes both of said inclined surfaces.

* * * * *